United States Patent [19]

Edell

[11] 4,331,237

[45] May 25, 1982

[54] SECURE DISPLAY CLIP

[75] Inventor: Morton Edell, West Orange, N.J.

[73] Assignee: Hazel Bishop Industries Inc., Ramsey, N.J.

[21] Appl. No.: 163,263

[22] Filed: Jun. 26, 1980

[51] Int. Cl.[3] ..... B65D 73/00

[52] U.S. Cl. ..... 206/461; 206/45.31; 206/229; 206/471

[58] Field of Search ..... 206/461, 464, 469, 481, 206/480, 471, 477, 479, 45.31

[56] References Cited

U.S. PATENT DOCUMENTS 3,289,830 12/1966 Foote ..... 206/469

3,404,774 10/1968 Levine ..... 206/464

*Primary Examiner*—William T. Dixson, Jr.

*Attorney, Agent, or Firm*—Fleit & Jacobson

[57] ABSTRACT

A display clip for holding a container in position with respect to a display card comprises an upper loop surrounding an upper portion of the container and a lower loop surrounding a lower portion of the container, each loop including a top surface portion and a bottom surface portion, respectively, for restraining movement of the container in a vertical direction parallel to the plane of the display card, side portions for restraining movement of the container in a horizontal direction parallel to the plane of the display card, front surface portions for restraining movement of the container in a horizontal direction away from the plane of the display card, and tab portions for joining the display clip to the display card so as to securely hold the container in position with respect to the display card. Preferably, the display clip is formed into an integral unit of thermoplastic and/or transparent material.

6 Claims, 5 Drawing Figures

FIG. 1
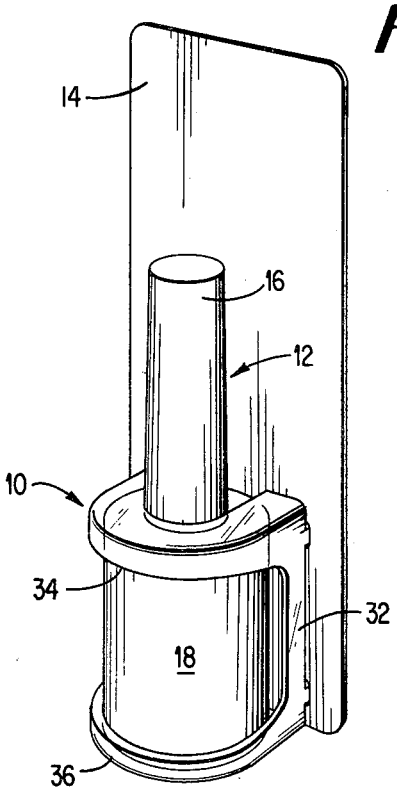
FIG. 2
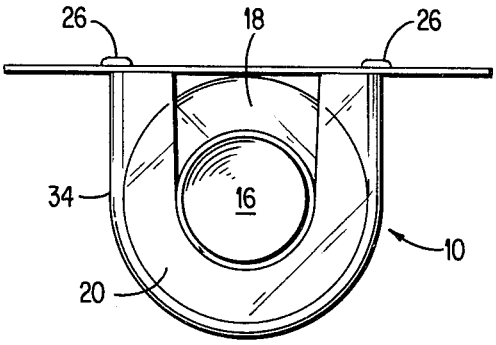
FIG. 4
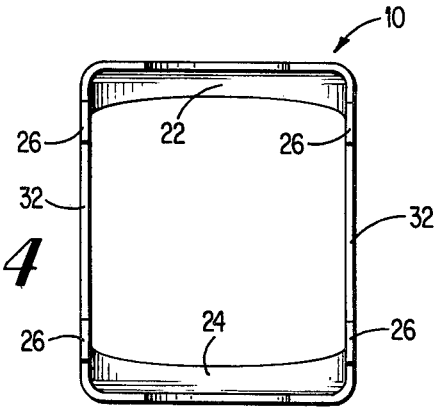
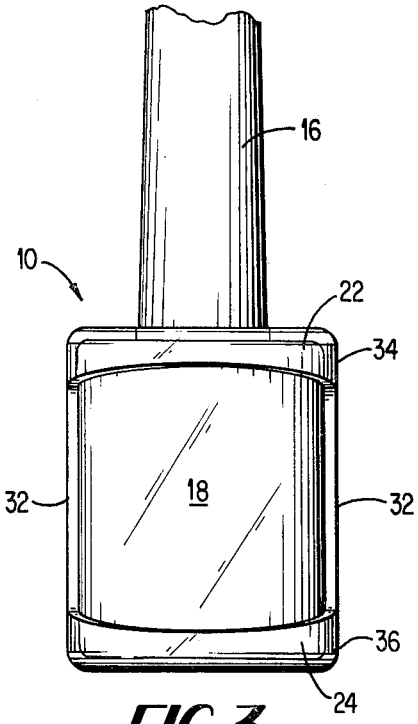
FIG. 3
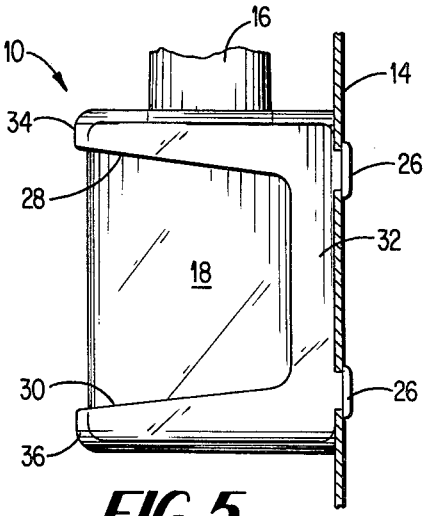
FIG. 5

SECURE DISPLAY CLIP

BACKGROUND OF THE INVENTION

The present invention relates to a secure display clip for securing a container to a display card. For example, the secure display clip of the present invention may be utilized to secure a container containing a cosmetic, such as nail enamel, to a display card in such a manner as to preclude easy removal of the container from the display card by a customer.

Past techniques for securing a container to a display card have been burdened by a disadvantage, in that means were not provided for securely fixing the container to the display card so that, prior to the sale of the item, the container could be easily removed from the display card by a customer. Such techniques have included fixing the container to the display card by means of some sort of weak restraining means, such as paper, tape or an elastic band. Such restraining means not only were ineffectual in precluding or virtually precluding removal of the container from the display card prior to sale, but also covered the label of the container, thus impeding the effectiveness of the identification and advertisement information typically contained on the exterior face of the container.

Recent efforts to overcome the disadvantages of the prior art have resulted in the development of a technique, whereby a container is totally encased in a thermoplastic (and thus, transparent) covering, the latter being fixed (by glue, or other means) to the display card. However, such a technique also has disadvantages, among which are lack of economy and complexity in the operation of mounting the container on, and fixing it to, the display card.

SUMMARY OF THE INVENTION

Therefore, in accordance with the present invention, there is provided a secure display clip for securely fixing a container to a display card.

More specifically, according to the present invention, a strong and durable display clip (made, for example, of thermoplastic material) is provided for mounting the container on, and fixing it to, a display card. Moreover, the inventive display clip is specially designed to hold the container in position with respect to the display card, limiting movement of the container with respect to the display card in all directions. In contrast to the prior art techniques of employing plastic bands, tape, elastic bands, or the like, the secure display clip of the present invention is equipped with means for preventing removal of the container from its position on the display card, thus virtually preventing customer removal of, or tampering with, the container.

Accordingly, it is a primary object of the present invention to provide a secure display clip for mounting a container on a display card.

It is another object of the present invention to provide a secure display clip, by means of which a container may be mounted on a display card so as to be virtually unremovable and tamper-proof.

It is an additional object of the present invention to provide a secure display clip, by means of which the container is held in position with respect to the display card by restraining its movement in all directions.

The above and other objects that will hereinafter appear, and the nature of the invention, will be more clearly understood by reference to the following description, the appended claims, and the accompanying drawings.

BRIEF DESCRIPTION OF THE DRAWINGS

FIG. 1 is a perspective view of the display clip of the present invention, securing a container to a display card.

FIG. 2 is a top view of the display clip, container and display card of FIG. 1.

FIG. 3 is a front view of the display clip, container and display card of FIG. 1.

FIG. 4 is a rear view of the display clip of the present invention.

FIG. 5 is a side view of the display clip, container and display card of FIG. 1.

DETAIL DESCRIPTION

The present invention will now be more fully described with reference to FIG. 1, which is a perspective view of the display clip of the present invention, securing a container to a display card.

As seen in FIG. 1, the display clip 10 securely fixes the container 12 to the display card 14. The container 12 comprises a removable top 16 and a main body 18. The display clip 10 basically comprises an upper loop 34 and a lower loop 36, which surround upper and lower portions, respectively, of the main body 18 of the container 12, and which are joined by vertical joining portions 32.

As stated previously, in a preferred embodiment, the display clip is made of transparent thermoplastic material, so that any identification or advertising information contained on the outside surface of the main body 18 of the container 12 is readily visible to the customer.

The display clip 10 will now be described in more detail, with reference to FIGS. 2–5 of the drawings. As seen in FIGS. 2, 4 and 5, which are top, rear and side views, respectively, of the display clip 10, the display clip 10 is equipped with tabs 26. As can be best seen in FIG. 4, these tabs 26 are, prior to mounting of the display clip 10 on the display card 14, in the form of squared portions (preferably, of thermoplastic material) projecting from the rear of the display clip 10. Although various conventional means for securely mounting the display clip 10 on the display card 10 can be employed, in a preferred embodiment, the squared tab portions 26 of display clip 10 are inserted through holes in the display card 14, and are then subjected to heat and pressure so as to spread out and flatten the tabs 26 against the rear face of the display card 14 (see FIG. 5), thus securely mounting the display clip 10 onto the display card 14. Since the display clip 10 surrounds the main body 18 of the container 12, the display clip 10 holds the container 12 in position against the display card 14, preventing horizontal movement of the container 12 away from the display card 14.

As best seen in FIGS. 1, 2 and 3, the upper loop 34 of the display clip 10 is formed into a top surface portion 20 and an upper vertical front surface portion 22, the portions 20 and 22 joining to surround the top portion of the main body 18 of the container 12. Furthermore, whereas FIG. 2 shows a top view of the display clip 10, container 12 and display card 14 of FIG. 1, it is to be understood that a bottom view of those elements constitutes a mirror image of the top view. Thus, the bottom loop 36 of the display clip 10 has a bottom surface portion (not shown, but corresponding to portion 20 of FIG. 2 described above) and a lower vertical front surface portion 24 (FIG. 3), these latter portions serving to surround the bottom portion of the main body 18 of the container 12. As a result of these features of the display clip 10, as thus described, display clip 10 further restrains the container 12 so as to prevent movement thereof in the vertical direction, that is, parallel to the plane of the display card 14.

Finally, as best seen in FIG. 5, which is a side view of the display clip, container and display card of FIG. 1, the upper and lower loops 34 and 36, respectively, of the display clip 10 include upper side surface portion 28 and lower side surface portion 30, respectively. Portions 28 and 30 are joined by vertical joining portions 32. As also seen in FIG. 5, the portions 28, 30 and 32 are dimensioned so as to overlap and surround upper, lower and vertical portions, respectively, of the main body 18 of the container 12. In this manner, the display clip 10 further restrains the container 12 so as to preclude movement thereof in the horizontal direction parallel to the plane of the display card 14.

Whereas the display clip 10 has been described above in terms of various portions (for example, top surface portion 20, upper vertical front surface portion 22, lower vertical front surface portion 24, etc.), it is to be understood that, in a preferred embodiment of the display clip of the present invention, the various portions of the display clip 10 are formed by thermoplastic processing techniques into a single, integral thermoplastic (and, preferably, transparent) unit.

While preferred forms and arrangement have been shown and illustrated in the invention, it is to be clearly understood that various changes in detail and arrangement may be made without departing from the spirit and scope of this disclosure.

What is claimed is:

1. A display clip for holding a container in position with respect to a display card, said display card defining a plane and horizontal and vertical directions of movement parallel to said plane, said container having an upper portion and a lower portion, said display clip comprising:

an upper loop surrounding said upper portion of said container, and including a top surface portion restraining said container from moving in said vertical direction parallel to said plane of said display card, and a front surface portion restraining said container from moving in said horizontal direction away from said plane of said display card;

a bottom loop surrounding said lower portion of said container, and including a bottom surface portion restraining said container from moving in said vertical direction parallel to said plane of said display card, and a front surface portion restraining said container from moving in said horizontal direction away from said plane of said display card;

said upper loop and said lower loop each including side portions for restraining said container from moving in said horizontal direction parallel to said plane of said display card;

vertical joining portions interconnecting said upper loop and said lower loop at their side portions; and means for joining said display clip to said display card comprising tab portions projecting from said side portions in a direction perpendicular to said plane of said display card, said display card having openings for receiving said tab portions of said display clip, and wherein the distance between the said front surface portions of said upper loop and said lower loop and the said tabs is such that said vertical joining portions and said container are held in close cooperation with said display card.

2. The display clip of claim 1, wherein at least one of said upper loop and said lower loop is made of thermoplastic material.

3. The display clip of claim 1, wherein at least one of said upper loop and said lower loop is made of transparent material.

4. The display clip of claim 1 wherein said upper loop is a mirror image of said lower loop and wherein said upper and lower loops are mounted symmetrically and interchangeably about said vertical joining portions.

5. A container and display assembly comprising in combination:

a flat display card; a cylindrical container having an upper portion and a lower portion; and a display clip means;

said container and display clip means including cooperating portions retaining the container on said display card, and restricting said container against vertical and horizontal movement with respect to said display card;

said cooperating portions of said display clip means comprising an upper loop surrounding said upper portion of said container, a bottom loop surrounding said lower portion of said container, and integral vertical joining portions interconnecting the upper loop and the lower loop, said loops being the mirror image of each other; and means for joining said display clip to said display card whereby an opening is formed in said clip around said cylindrical container for grasping said container to thereby rotate said container within said clip means without disturbing the combination assembly.

6. The container and display assembly as recited in claim 5 wherein said means for joining said display clip to said display card comprise tab portions projecting from said side portions in a direction perpendicular to said plane of said display card, said display card having openings for receiving said tab portions of said display clips, wherein the dimensions of said upper loop and said lower loop in relation to the dimensions of said container and the dimensions of said tabs are such that said vertical joining portions and said container are held in close cooperation against the said display card.

* * * * *